US005126979A

United States Patent [19]

Rowe, Jr. et al.

[11] Patent Number: 5,126,979

[45] Date of Patent: Jun. 30, 1992

[54] VARIABLE RELUCTANCE ACTUATED FLEXTENSION TRANSDUCER

[75] Inventors: Linwood M. Rowe, Jr., Severna Park; Thomas C. Montgomery, Easton, both of Md.; Thomas Kupiszewski, Harrison City; David Marschik, Murrysville, both of Pa.

[73] Assignee: Westinghouse Electric Corp., Pittsburgh, Pa.

[21] Appl. No.: 772,508

[22] Filed: Oct. 7, 1991

[51] Int. Cl.[5] ..... H04R 9/00

[52] U.S. Cl. ..... 367/175; 367/185; 181/110

[58] Field of Search ..... 367/175, 174, 185; 181/110, 113, 142; 381/192, 194, 200

[56] References Cited

U.S. PATENT DOCUMENTS

| | | | |
|---|---|---|---|
| 3,274,537 | 9/1966 | Toulis | 367/155 |
| 3,277,433 | 10/1966 | Toulis | 367/155 |
| 3,466,017 | 9/1969 | Malvin | 367/174 |
| 4,016,436 | 4/1977 | Shoh | 310/8.2 |
| 4,287,582 | 9/1981 | Tocquet | 367/163 |
| 4,384,351 | 5/1983 | Pagliarini, Jr. et al. | 367/175 |
| 4,409,681 | 10/1983 | White | 367/166 |
| 4,420,826 | 12/1983 | Marshall, Jr. et al. | 367/167 |
| 4,764,907 | 8/1988 | Dalstrom et al. | 367/163 |
| 4,845,688 | 7/1989 | Butler | 367/174 |
| 4,858,206 | 8/1989 | McMahon | 367/163 |
| 4,862,429 | 8/1989 | Rolt | 367/165 |
| 4,864,548 | 9/1989 | Butler | 367/155 |
| 4,901,293 | 2/1990 | Kuhn | 367/168 |

*Primary Examiner*—J. W. Eldred
*Attorney, Agent, or Firm*—D. Schron

[57] ABSTRACT

An underwater acoustic projector including a Class IV flextension shell, preferably in the form of an ellipsoid, is connected to and driven by two substantially identical electromagnets having mutually opposing pole faces and having a common spatially uniform air gap which is centered between the pole faces. The coils of the two electromagnets are connected in series and when excited by a controlled current, generate a mutually attractive variable reluctance force which causes the pole faces to be attracted toward one another. The shell secured to the electromagnets elastically flexes along one of two mutually perpendicular axes resulting in a volumetric displacement of the outer surface of the shell.

11 Claims, 3 Drawing Sheets

VARIABLE RELUCTANCE ACTUATED FLEXTENSION TRANSDUCER

BACKGROUND OF THE INVENTION

This invention relates generally to sonic generators and more particularly to a relatively low frequency active sonar transmitter type sonic generator.

Underwater acoustic projectors are generally well known. In order to reduce the size of low frequency underwater acoustic projectors, one known approach is to increase monopole volume velocity by increasing displacement of the radiating surface. When a low frequency sonar projector of the known prior art is driven by a linear electromagnetic actuator, then large relatively high velocity displacement of the radiating surface requires the use of linear motion bearings and sufficient compliance of the radiating surface periphery. These requirements, irrespective of whether or not the linear electromagnetic actuator is of the homopolar or variable reluctance type, result in the following undesirable results: (a) unwanted noise and heat generated by bearing components, (b) the shunting of acoustic energy away from the load by peripheral compliances, and (c) the constraint of operating depth due to the limitations of the necessary pressure compensation elements located internally of the transducer housing.

SUMMARY

It is an object of the present invention, therefore, to provide an improvement in underwater acoustic projectors.

It is another object of the invention to provide an improvement in relatively low frequency underwater acoustic projectors which obviates the need for linear bearings.

A further object of the invention is to provide an improvement in low frequency underwater acoustic projectors which exhibit depth invariant performance without internal pressure compensation.

And still a further object of the invention is to provide a low frequency underwater acoustic projector which is driven by a controlled variable reluctance force directed along one of two mutually perpendicular axes.

The foregoing and other objects are achieved by an underwater acoustic projector which is comprised of a Class IV flextension shell preferably in the form of an ellipsoid coupled to and driven by two substantially identical electromagnets having mutually opposing pole faces and having a common spatially uniform air gap which is centered between the pole faces. The coils of the two electromagnets are connected in series and when excited by a controlled current, generate a variable reluctance force resulting from time fluctuating magnetic fields, causing the pole faces to be mutually attracted toward one another. This causes the shell secured to the electromagnets to elastically flex along one of two mutually perpendicular axes and results in a volumetric displacement of the outer surface of the shell, generating a low frequency sonar transmitter signal thereby.

DETAILED DESCRIPTION OF THE INVENTION

This invention is directed to a means for driving a Class IV flextension shell in a quadrapole volumetric mode via the generation of a pair of controlled variable reluctance forces directed along one of two axes of an ellipsoidal acoustic transducer used in sonar apparatus for generating a low frequency signal and which is thereafter transmitted through a water medium from a radiating surface of the transducer.

Figure 1A:
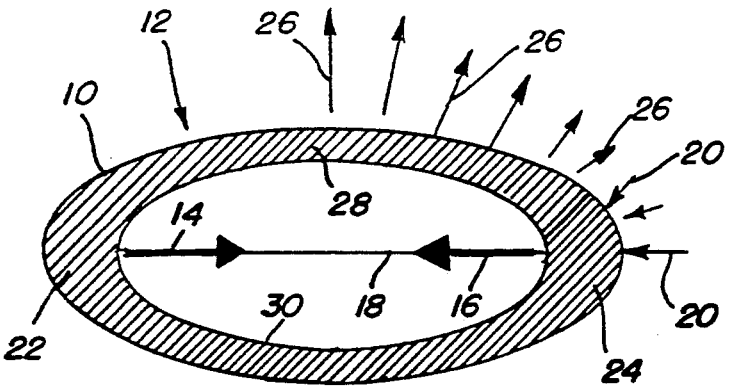
FIGS. 1A and 1B are generally illustrative of the effects of actuating an ellipsoidal transducer in accordance with the subject invention along major and minor axes, respectively.

As shown in FIG. 1A, the radiating surface comprises the elliptical outer surface 10 of a Class IV flextension shell or body member 12 which is driven by a pair of oppositely directed variable reluctance forces 14 and 16. These driving forces are directed along the major axis 18 of the body 10 which is in the form of an ellipsoid. As shown, the variable reluctance forces 14 and 16 directed along the major axis 18 cause inward deflection as shown by the arrows 20 at the outer extremity regions 22 and 24. This elastic deflection causes a resulting outward flexural motion of the body 12 as shown by the arrows 26 along the intermediate regions 28 and 30.

Figure 1B:
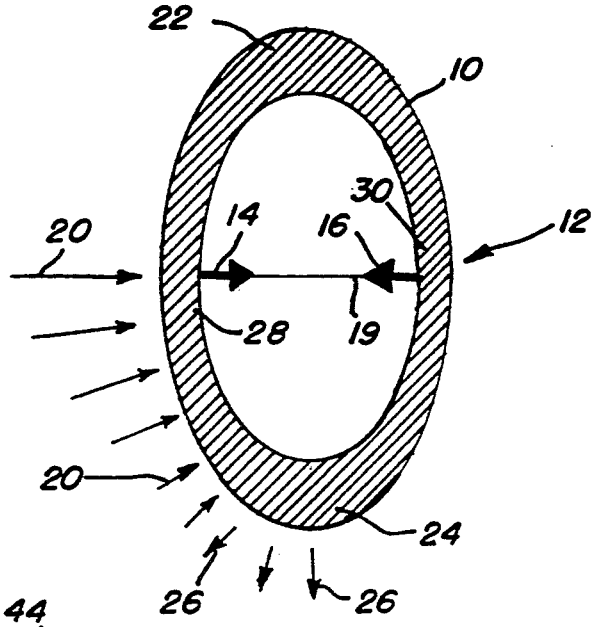

As shown in FIG. 1B, when the variable reluctance forces 14 and 16 are applied along the minor axis 19 of the ellipsoidal shell body 12, outwardly directed deflection motion 26 is now produced in the extremity regions 22 and 24, while an inwardly directed deflection motion 20 is provided in the intermediate regions 28 and 30.

Figure 2:
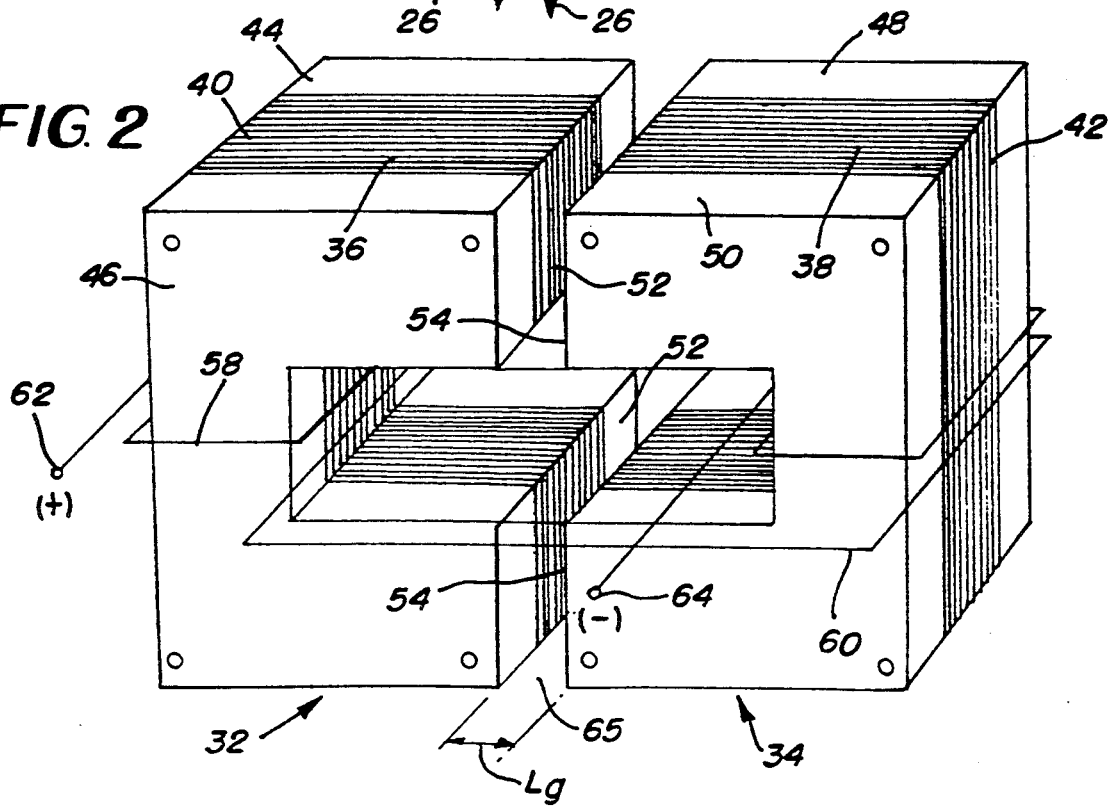
FIG. 2 is a perspective view illustrative of a dual electromagnet assembly for providing a variable reluctance drive for the apparatus of the subject invention.
Figure 4:
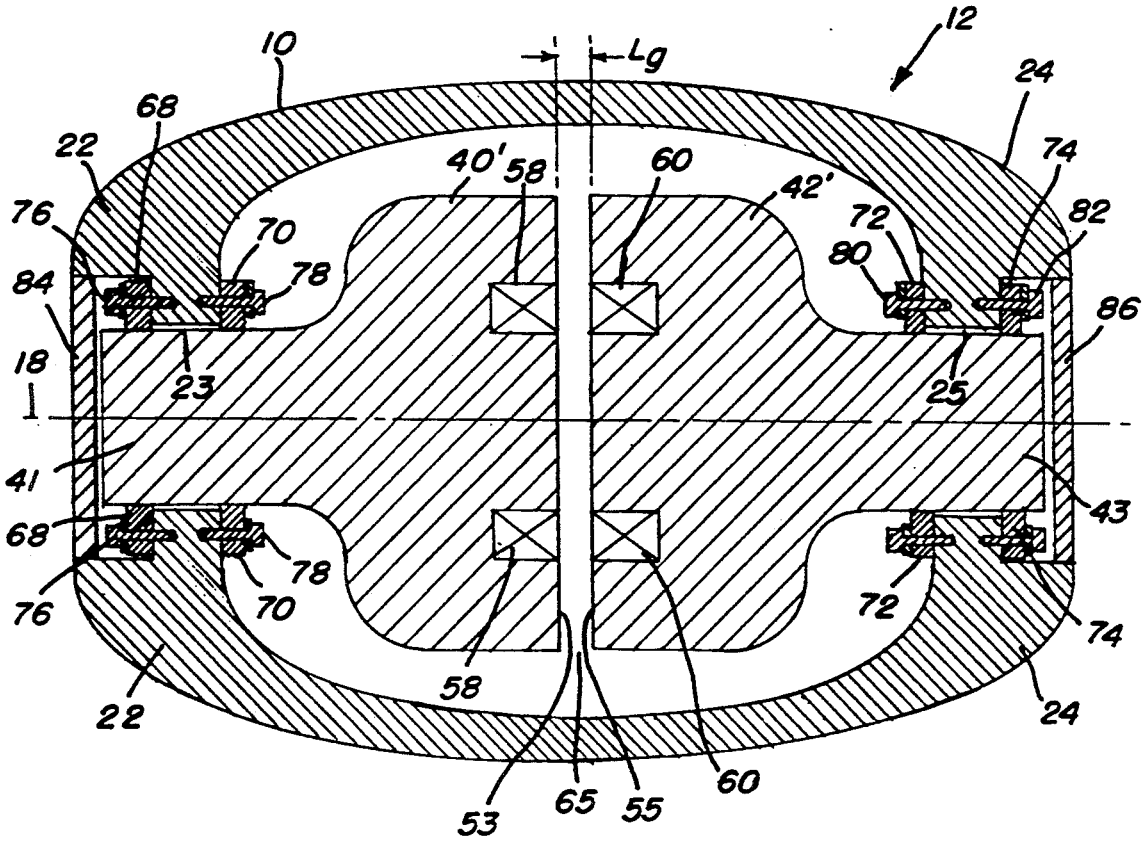
FIG. 4 is a central longitudinal cross section illustrative of one preferred embodiment of the invention.

In the subject invention, the variable reluctance forces 14 and 16 are generated by two identical electromagnets 32 and 34 as shown in FIG. 2 coupled to an elastically flexible shell 12 such as shown in FIG. 4, for example. Each of the electromagnets 32 and 34 include respective bifurcated ferromagnetic cores 36 and 38 shown as a C shaped core and being comprised of a clamped stack of insulated ferromagnetic alloy laminations 40 and 42 and which are held together by respective pairs of insulator type end-plates 44, 46 and 48, 50. While the core shapes are shown as being C sections, it should be noted that when desirable, E sections can be employed. The resulting configuration results in pairs of opposing pole faces 52 and 54. Further as shown in FIG. 2, each of the electromagnets 32 and 34 includes a respective multi-turn coil 58 and 60 comprised of insulated electrical conductors wound around the cores 36 and 38 and connected in series between two electrical terminals 62 and 64. The pole faces 52 and 54 are separated by an air gap 65.

Figure 3:
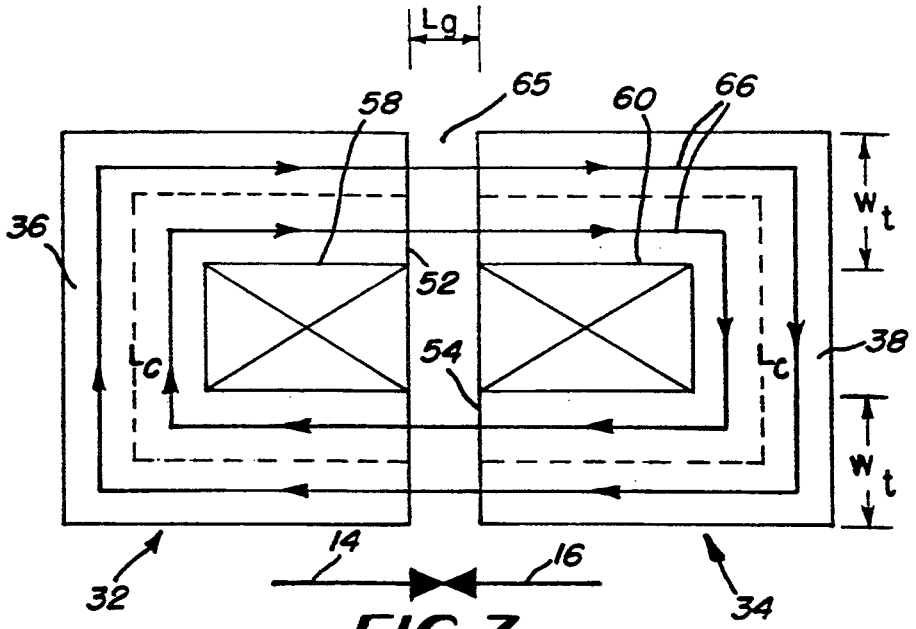
FIG. 3 is a diagram helpful in understanding the operation of the electromagnet circuitry of FIG. 2.

When an electrical current flows in the series connected coils 58 and 60, magnetic flux 66, as shown in FIG. 3, circulates from one core 36, across the air gap 65, and through the other core 38. The net developed magnetic force is one of attraction acting orthogonal to the pole faces 52 and 54.

This now leads to a consideration of FIG. 4, wherein there is shown a central longitudinal cross section of a first embodiment of the invention wherein the elastic shell 12 includes outer sections 22 and 24 having a gradually enlarged thickness which terminates in end passages 23 and 25 which provide respective mounting locations for a stack of core laminations 40' and 42' having reduced sized end portions 41 and 43. The end portions 41 and 43 are secured to the end sections 22 and 24 of the shell by means of pairs of base plates 68, 70 and 72, 74 which are held in position by sets of threaded fasteners 76, 78, and 80, 82. The end portions 41 and 43 of the cores 40' and 42' are welded to the base plates 68, 70 and 72, 74 following which end cover plates 84 and 86 are set in place to seal the assembly against moisture. Bonding of the cover plates 84 and 86 to the shell body 10 is by way of welding or brazing. It is to be noted, however, that brittle epoxy joints are not utilized. Thus a rigid low compliance connection is obtained between the shell body 12 and the electromagnet cores 40' and 42' which upon subsequent energization of the two coil assemblies 58' and 60', permits compression and extension of the shell 12 as it elastically deflects as a result of the mutual attraction of the pole faces 53 and 55.

It should also be realized that in the configuration as shown, the welded connections between elements are located far enough away from regions of intense changing magnetic fields so that any currents of significant magnitude are not induced in the fillet welds.

Figure 5:
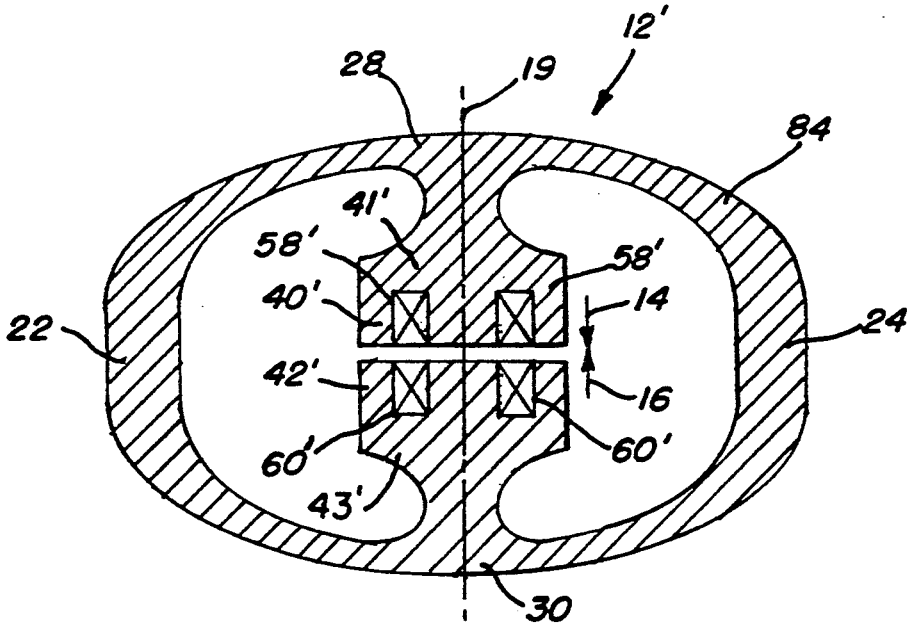
FIG. 5 is a central longitudinal cross sectional diagram of a second preferred embodiment of the invention.
Figure 6:
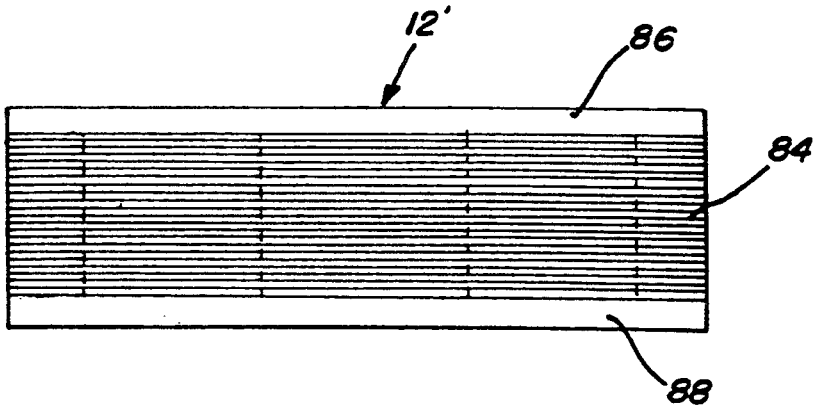
FIG. 6 is a top view of the configuration shown in FIG. 5.

A second embodiment of the invention is shown in FIG. 5 and comprises an arrangement wherein the electromagnetic cores 40' and 42' are integrated into a flexible body 12' along the minor axis 19 such that the core sections 41' and 43' join the body 12' in the side regions 28 and 30, respectively. Now the entire assembly including the body 12' is formed by a single stack of ferromagnetic laminations 84 shown in FIG. 6, and which are preloaded in compression between two non-conducting end plates 86 and 88. The compression pre-load of the laminations 84 is of sufficient magnitude to prevent vibration damping in the form of interlaminar slippage between adjacent laminations. Also in the arrangement shown in FIGS. 5 and 6, the assembly comprises a planar configuration as opposed to a closed volume configuration.

Depth invariant operation is achieved by setting the initial air gap thickness $L_g$ (FIG. 3) to be very large relative to the maximum shell deflection occurring over the anticipated range of operating depth. No pressure compensation system, such as compliant tubes, belleville springs, pressurized air bladders, etc. is required. Depth invariant operation can be demonstrated by formulating an equivalent reluctance circuit for the magnetic fields. Referring again to FIGS. 2 and 3, the total electromagnet reluctance, $R_{em}$, is the sum of the core and air gap reluctances in series and which can be stated as:

$$R_{em}=2(L_g/\mu_g W_t D_s)+L_c/(\mu_c W_t D_s) \quad (1)$$

where $L_g$ is the thickness of the air gap 65, $L_c$ is the mean magnetic path length of the flux 66, $\mu_g$ is the magnetic permeability of free space, $\mu_c$ is the magnetic permeability of the ferromagnetic laminations 40 and 42. $W_t$ is the width of the ferromagnetic laminations 40 and 42, and $D_s$ is the thickness of the cores 36 and 38. This formulation is based upon the simplifying assumptions that the ferromagnetic alloys are not saturated, magnetic permeability is constant, and slot leakage and fringing fields are negligible due to proper design of the cores 36 and 38. Furthermore, since $L_c/\mu_c$ is 1 to 2 orders of magnitude less than $L_g/\mu_g$ due to the high value of $\mu_c$ for most ferromagnetic lamination materials, $R_{em}$ can be reasonably approximated by $2\,L_g/(\mu_g W_t D_s)$. The magnitude of the magnetic flux, $\phi$, crossing the air gap, is then given approximately by:

$$\phi=NI/R_{em}$$

$$=NI\mu_g W_t D_s/(2\,L_g) \quad (2)$$

where N is the total number of coil turns for both cores 58 and 60 and I is the electrical current in number of amperes per turn.

Invoking the Maxwell Stress Tensor or the principle of Virtual Work, one can express the variable reluctance force, or electromagnet attraction force, as being proportional to the flux squared. Therefore, an equivalent proportionality is that the electromagnet attraction force is proportional to the square of $1/L_g$ or $1/L_g^2$. For purposes of illustration, consider the following. A flextension shell transducer has a variable reluctance drive acting along the shell minor axis 19 (FIG. 5). If, for example, the shell deflection in the direction of the shell minor axis is linear with operating depth and on the order of 0.01"for a depth variation of 0' to 1000' and the initial air gap thickness $L_g$ is 1.0", then the constant current electromagnetic force driving the flextension transducer would vary on the order of 1% per 1000' submergence.

In the case of a flextension shell transducer with a piezoelectric drive according to the known prior art, one of the factors limiting depth of operation is that compression preloading of the piezoelectric ceramic stack is progressively negated as depth increases, thereby allowing the piezoelectric stack to fail in tension. Hence, the practical implementation of the invention as described herein does not necessitate pressure compensation.

In addition to not requiring pressure compensation, the invention dispenses with the need for linear bearings and the associated periphery compliance of the radiating surface. The shell serves the functions of holding and orienting the variable reluctance drive as well as facilitating mechanical to acoustical power transfer between the drive and the water. The invention also assures that the center of mass of the variable reluctance drive coincides with the geometric center of the shell, which is a necessary condition for a flextension transducer to operate in the quadrupole volumetric mode.

Having thus shown and described what is at present considered to be the preferred embodiment of the invention, it should be noted that the same has been made by way of illustration and not limitation. Accordingly, all modifications, alterations and changes coming within the spirit and scope of the invention are herein meant to be included.

We claim:

1. A low frequency underwater acoustic projector for sonar apparatus, comprising:

a flextension body member consisting of a flexible ellipsoidal shell having mutually orthogonal central major and minor axes;

electromagnet means generating a variable reluctance force along one of said central axes for driving said body member in a quadrapole volumetric mode, said electromagnet means further comprising a pair of substantially identical electromagnets connected to opposite portions of said body member along said one axis and wherein said pair of electromagnets include laminated cores having mutually opposing pole faces with a common spatially uniform air gap therebetween and respective coil windings wound on said cores and connected so as to generate a mutually attractive pole face reluctance force when energized; and wherein said shell includes a pair of end passages located on one of said axes and said cores include end outer portions of reduced size for connection to said shell at said end passages.

2. The underwater acoustic projector of claim 1, wherein said cores include bifurcated inner end portions.

3. The underwater acoustic projector of claim 2 wherein said bifurcated inner end portions comprise C shaped portions.

4. The underwater acoustic projector of claim 2 wherein said bifurcated inner end portions comprise E shaped end portions.

5. The underwater acoustic projector of claim 1 wherein said cores further include pairs of outer plates comprised of insulator material.

6. The underwater acoustic projector of claim 2 wherein said one axis comprises the major axis and said pair of end passages are located on the major axis.

7. The underwater acoustic projector of claim 1 and additionally including means for connecting the outer end portions of said cores to said end passages.

8. The underwater acoustic projector of claim 1 and additionally including a pair of cover plates secured to said shell for closing said pair of end passages.

9. The underwater acoustic projector of claim 1 wherein said pair of electromagnets are connected to opposite end portions of said shell along said major axis.

10. The underwater acoustic projector of claim 1 wherein said pair of electromagnets are connected to opposite portions of said shell along said minor axis.

11. The underwater acoustic projector of claim 1 wherein said coil windings are connected in series.

* * * * *